US007429090B2

(12) United States Patent
Salice

(10) Patent No.: US 7,429,090 B2
(45) Date of Patent: Sep. 30, 2008

(54) ATTACHMENT DEVICE FOR DRAWER FRONT PANELS

(75) Inventor: Luciano Salice, Carimate (IT)

(73) Assignee: Arturo Salice, SpA, Novedrate (Como) (IT)

( * ) Notice: Subject to any disclaimer, the term of this patent is extended or adjusted under 35 U.S.C. 154(b) by 133 days.

(21) Appl. No.: 10/896,245

(22) Filed: Jul. 21, 2004

(65) Prior Publication Data

US 2005/0017615 A1 Jan. 27, 2005

(30) Foreign Application Priority Data

Jul. 21, 2003 (DE) ..... 203 11 190 U

(51) Int. Cl.
*A47B 88/00* (2006.01)

(52) U.S. Cl. ..... 312/348.4

(58) Field of Classification Search ..... 312/348.1, 312/348.2, 348.4, 334.1, 330.1, 334.7, 334.4
See application file for complete search history.

(56) References Cited

U.S. PATENT DOCUMENTS

| | | | | |
|---|---|---|---|---|
| 4,815,796 | A * | 3/1989 | Rock et al. | 312/263 |
| 5,281,022 | A * | 1/1994 | Rock | 312/348.4 |
| 6,027,194 | A * | 2/2000 | Fleisch | 312/348.4 |
| 6,179,399 | B1 * | 1/2001 | Brustle et al. | 312/348.4 |
| 6,286,919 | B1 * | 9/2001 | Fleisch | 312/348.4 |
| 2004/0000849 | A1 * | 1/2004 | Ham et al. | 312/330.1 |

FOREIGN PATENT DOCUMENTS

| | | |
|---|---|---|
| AT | 391409 | 4/1990 |
| DE | 3713254 | 11/1987 |
| EP | 0289866 | 6/1991 |
| EP | 0761131 | 3/1997 |
| EP | 0862873 | 9/1998 |
| EP | 0875176 | 11/1998 |
| EP | 0916286 | 5/1999 |

* cited by examiner

*Primary Examiner*—James O Hansen
(74) *Attorney, Agent, or Firm*—Dilworth & Barrese, LLP

(57) ABSTRACT

The present invention relates to a device for attaching a front panel to drawer frames, each of which has a recess on its face in which a block attached to the front panel, which has holding parts delimiting a groove, may be inserted on any side of the drawer in such a way that the front ends of the drawer frame are enclosed on both sides by the holding parts and are locked by attachment means which penetrate the recess. According to the present invention, the block has a projecting leaf spring, which is aligned parallel to the drawer frame, or a spring-loaded lever, one edge of which engages behind a transversely angled projection in the region of the recess of the drawer frame in the assembled state. Furthermore, a support plate, which is displaceable by an eccentric and is attached to the front panel, is guided on the block.

22 Claims, 2 Drawing Sheets

ATTACHMENT DEVICE FOR DRAWER FRONT PANELS

BACKGROUND OF THE INVENTION

The present invention relates to a device for attaching a front panel to drawer frames.

Attachment devices of this type are known, for example, from DE 37 13 254 C, EP 0 289 866 B1, and EP 0 761 131 A2. Each of these devices has a recess on its face into which a block attached to the front panel may be inserted in such a way that the front ends of the drawer frames are enclosed on both sides by holding parts provided in the block. The front panel is locked by attachment means which penetrate the recess. According to the above-mentioned related art, these attachment means are screws.

The object of the present invention is to refine a device of the type initially cited in such a way that it may be attached and detached again without tools and it is possible to adjust the height of the front screen without having to actuate corresponding attachment means.

This object is achieved according to the present invention by the combination of the features herein. Accordingly, starting from a device according to the species for attaching a front panel to drawer frames, each of which has a recess on its face into which a block attached to the front screen, which has holding parts delimiting a groove, may be inserted on any side of the drawer in such a way that the front ends of the drawer frame are enclosed on both sides by the holding parts and are locked by attachment means which penetrate the recess. According to the present invention the block has a projecting leaf spring, aligned parallel to the drawer frame, one edge of which engages behind a transversely angled projection in the region of the recess of the drawer frame in the assembled state, and a support plate, which is attached to the front screen and may be displaced by an eccentric, is guided on the block.

Preferred refinements of the present invention result from the description herein. Accordingly, the block, which has holding parts delimiting a groove, may be implemented in one piece.

According to an alternative embodiment of the present invention, the block may be assembled from multiple parts, the block able to have two separate holding parts between which the leaf spring is received.

The support plate may advantageously have a C-shaped cross-section and be guided displaceably along vertical edges of the holding parts.

BRIEF DESCRIPTION OF THE DRAWINGS

Further details and advantages of the present invention result from a preferred embodiment of the present invention illustrated in the attached figures.

DESCRIPTION OF THE PREFERRED EMBODIMENTS

Figure 3:
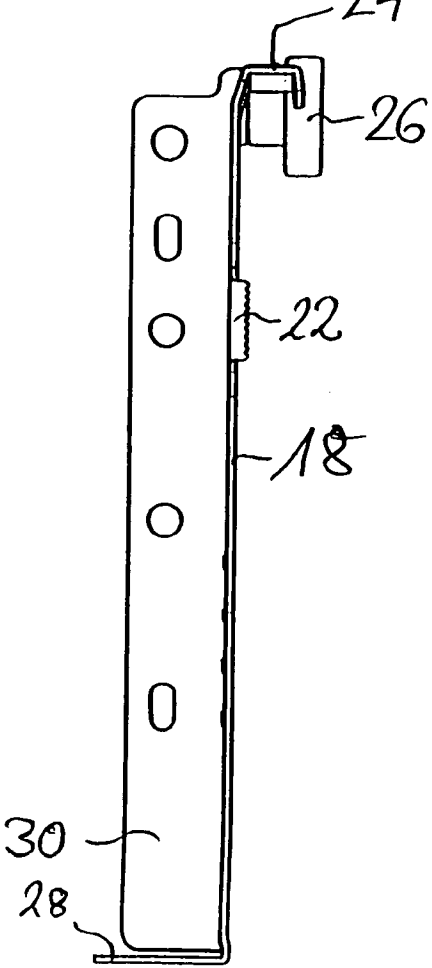
FIG. 3 shows a front view of the drawer frame shown in FIG. 2.
Figure 2:
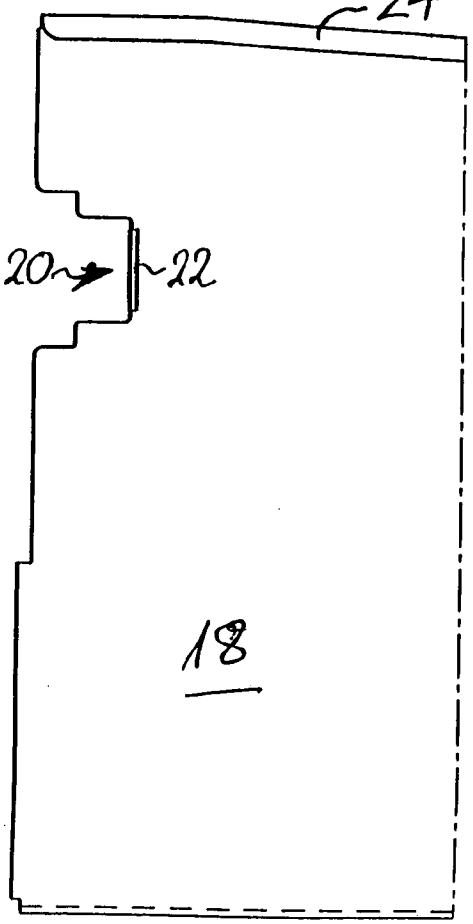
FIG. 2 shows a partial side view of a drawer frame.
Figure 1:
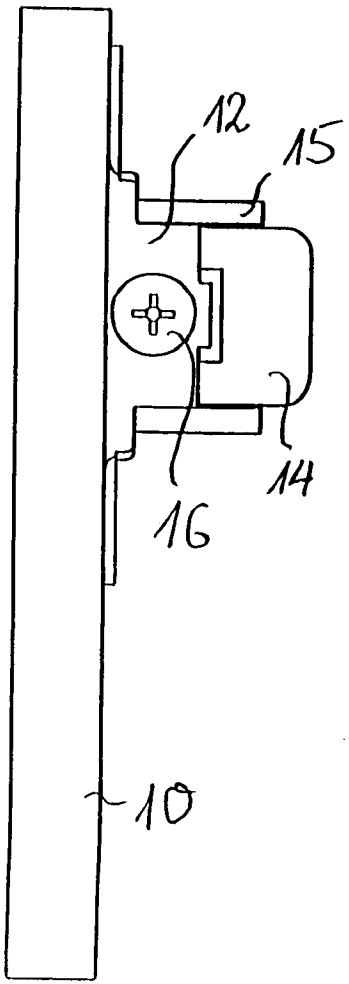
FIG. 1 shows a side view of a front panel having an attachment device according to the present invention.

A front panel 10 having a projecting attachment device, which essentially includes a support plate 12, a leaf spring 14, a block 15, and an eccentric 16, is shown in FIG. 1. A metal drawer frame 18 is shown in a side view in FIG. 2 and in a front view in FIG. 3. The front end of the drawer frame 18 has a recess 20 which runs freely to the outside and whose edges are implemented as stepped. The rear edge of the recess may be angled to the outside by approximately 90° to form a projection 22. If the angle is somewhat less than 90°, the leaf spring 14 may exert a small clamping force between front panel 10 and drawer frame 18.

The drawer frame 18 is typically provided with a slide rail 24, a slide roller 26, and angled parts 28 and 30, each of which are provided for attaching a floor and a back wall of the drawer (not shown here). These parts are known per se and do not require any further description here.

The block 15 may be implemented in one piece in principle, a central part, which is implemented as complementary to the recess 20 of the drawer frame, being positioned between two holding parts parallel to one another, which delimit a groove 33. The width of the groove corresponds to the height of this central part and is somewhat greater than the thickness of the drawer frame. On one side of the groove, the leaf spring 14 is inserted into the block and attached thereto.

Figure 4:
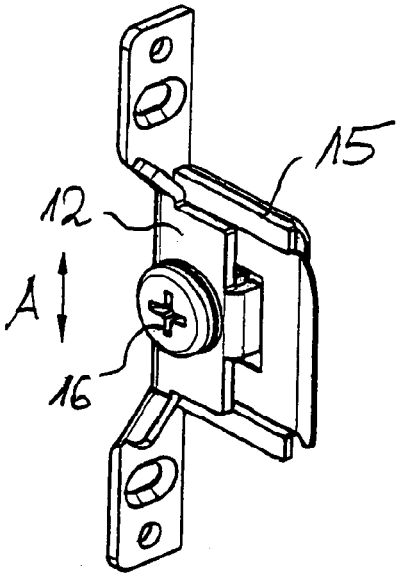
FIG. 4 shows a perspective view of a detail of the attachment device.
Figure 5:
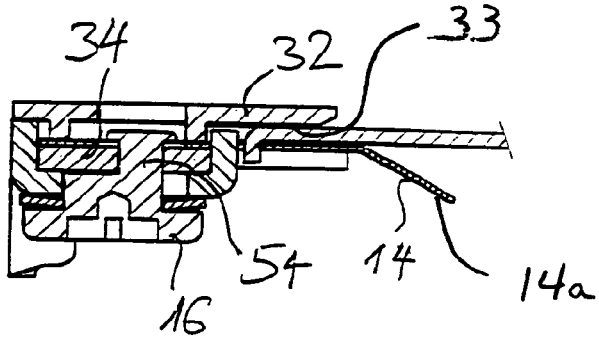
FIG. 5 shows a section through the attachment device shown in FIG. 4 in the installed state on a frame.
Figure 6:
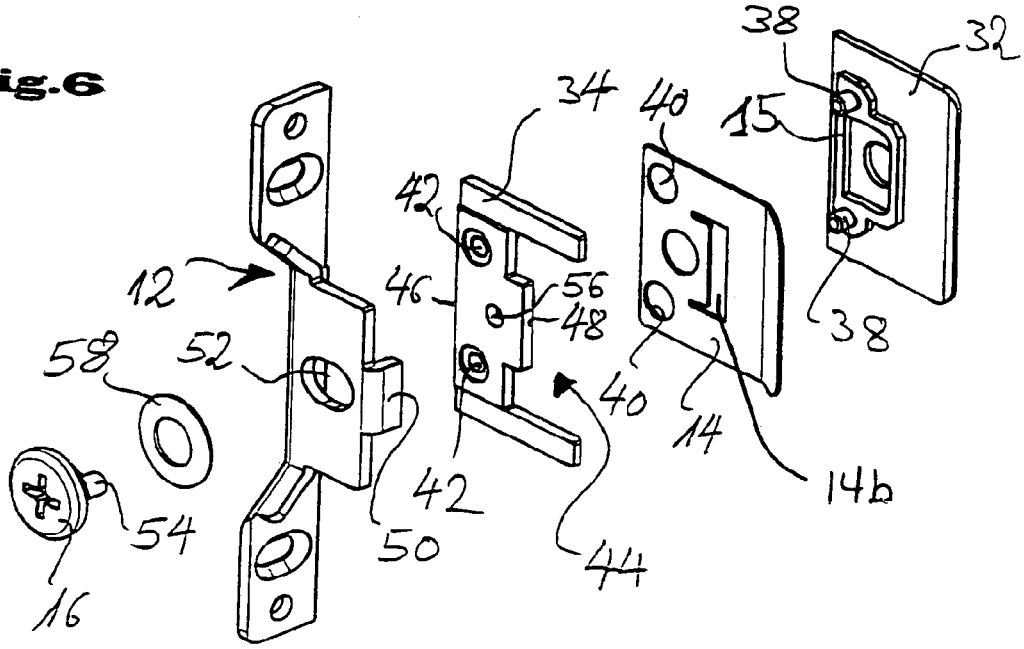
FIG. 6 shows an exploded view of the attachment device shown in FIG. 4.

An expedient embodiment of the block 15, which includes two separate holding parts 32 and 34, is shown in FIGS. 4 through 6. The holding part 32 has a part 15 shaped complementarily to the recess 20, which is riveted to the other holding part 34 by pins 38 after the leaf spring 14 is interposed. For this purpose, the leaf spring 14 and the holding part 34 are provided with holes 40 and 42.

In the assembled state, the leaf spring 14 which includes an elongated aperture 14*b* for disposal of recess projection 22, therefore on the side of the groove delimited by the holding parts 32 and 34 which corresponds to the outer side of the drawer frame 18 on which the projection 22 is positioned. The holding part 34 may be provided with a recess 44 so that the leaf spring may be pivoted freely.

The support plate 12, which has a C-shaped cross-section in some regions, is displaceably guided on vertical edges 46 and 48 of the holding part 34. To implement the C-shaped profile, the support plate has a lug 50, as may be seen from FIG. 6 in particular. An eccentric 16 penetrates an oblong hole 52 of the support plate 12 and its shaft 54 is riveted in a hole 56 of the holding part 34. A flat spring 58, which ensures a good pressure between support plate 12 and block 15 and simultaneously allows adjustment in the direction of the double arrow A (shown in FIG. 4), is mounted under the head of the eccentric 16.

The support plate 12 is screwed together with the front panel 10 in a typical way not described in greater detail here. The leaf spring 14 includes an angled actuation part 14*a*, which is angled outward in such a way that its actuation to detach the connection is possible without additional fittings, assembly on the left and right being ensured by this same device.

What is claimed is:

1. A device for attaching a front panel to drawer frames of a drawer, each drawer frame having a recess on its face in which a block is attached to the front panel, the device, including holding parts delimiting a groove, may be inserted on any side of the drawer in such a way that front ends of the drawer frames are enclosed by the holding parts and are locked by attachment means which penetrate the recess of each drawer frame, and characterized in that the block has a projecting leaf spring, which is aligned parallel to the drawer frame, or a spring-loaded lever, one end of said leaf spring or spring-loaded lever being fixedly mounted, said leaf spring or spring loaded lever including an elongated aperture defined by a freely movable rectilinear edge, which is configured for independent, resilient engagement with a transversely angled projection of the drawer frame in a region of the recess to lock the front panel with the drawer frame in the assembled state, said transversely angled projection being oriented perpendicular to the drawer frame, and a support plate, which is displaceable by an eccentric and is attached to the front panel, is guided on the block.

2. The device according to claim 1, characterized in that the block is implemented in one piece.

3. The device according to claim 2, characterized in that the support plate partially has a C-shaped cross-section and is guided displaceably along vertical edges of one of the holding parts.

4. The device according to claim 3, characterized in that the holding parts are implemented symmetrically to a central transverse axis for left and right assembly.

5. The device according to claim 2, characterized in that the holding parts are implemented symmetrically to a central transverse axis for left and right assembly.

6. The device according to claim 1, characterized in that the block is assembled from multiple parts.

7. The device according to claim 6, characterized in that the block has two separate holding parts, between which the leaf spring or the spring-loaded lever is received.

8. The device according to claim 7, characterized in that the support plate partially has a C-shaped cross-section and is guided displaceably along vertical edges of one of the holding parts.

9. The device according to claim 7, characterized in that the holding parts are implemented symmetrically to a central transverse axis for left and right assembly.

10. The device according to claim 6, characterized in that the support plate partially has a C-shaped cross-section and is guided displaceably along vertical edges of one of the holding parts.

11. The device according to claim 6, characterized in that the holding parts are implemented symmetrically to a central transverse axis for left and right assembly.

12. The device according to claim 1, characterized in that the support plate partially has a C-shaped cross-section and is guided displaceably along vertical edges of one of the holding parts.

13. The device according to claim 12, characterized in that the eccentric is provided with a head and penetrates a transversely-aligned oblong hole of the support plate and includes a lower eccentric shaft part which is riveted in a hole of one of the holding parts.

14. The device according to claim 13, characterized in that a flat second spring is mounted between the head of the eccentric and the support plate.

15. The device according to claim 14, characterized in that the holding parts are implemented symmetrically to a central transverse axis for left and right assembly.

16. The device according to claim 13, characterized in that the holding parts are implemented symmetrically to a central transverse axis for left and right assembly.

17. The device according to claim 12, characterized in that the holding parts are implemented symmetrically to a central transverse axis for left and right assembly.

18. The device according to claim 1, characterized in that the leaf spring or the spring-loaded lever is provided with an angled actuation and/or unlocking part.

19. The device according to claim 18, characterized in that the holding parts are implemented symmetrically to a central transverse axis for left and right assembly.

20. The device according to claim 1, characterized in that the holding parts are implemented symmetrically to a central transverse axis for left and right assembly.

21. The device according to claim 1, comprising:

two said holding parts (32, 34) situated on opposite sides of said leaf spring (14) and riveted together, and said support plate (12) mounted to be displaceable on one (34) of said holding parts (32, 34) by turning said eccentric (16).

22. A device for attaching a front panel to drawer frames of a drawer, each drawer frame having a recess on its face in which a block is attached to the front panel, the device, including holding parts delimiting a groove, may be inserted on any side of the drawer in such a way that the front ends of the drawer frames are enclosed by the holding parts and are locked by attachment means which penetrate the recess of each drawer frame, and characterized in that the block has a projecting leaf spring having one end which is fixedly mounted to the block and, which is aligned parallel to the drawer frame, the leaf spring having an elongated aperture at least partially defined by a rectilinear edge which is freely movable, wherein said rectilinear edge is configured for independent, resilient engagement with a transversely angled projection of the drawer frame in a region of the recess to lock the front panel with the drawer frame in the assembled state, the transversely angled projection being oriented perpendicular to the drawer frame, and a support plate, which is displaceable by an eccentric and is attached to the front panel, is guided on the block.

* * * * *